US008742299B2

(12) United States Patent
Gouardo et al.

(10) Patent No.: US 8,742,299 B2
(45) Date of Patent: Jun. 3, 2014

(54) METHOD FOR HEATING A CONTAINER PLACED ON A COOKTOP BY HEATING MEANS ASSOCIATED TO INDUCTORS

(75) Inventors: Didier Gouardo, Saran (FR); Cedric Goumy, St Jean de la Ruelle (FR); Alain Roux, Saint-Hilaire-Saint-Mesmin (FR)

(73) Assignee: FagorBrandt SAS, Rueil Malmaison (FR)

( * ) Notice: Subject to any disclaimer, the term of this patent is extended or adjusted under 35 U.S.C. 154(b) by 99 days.

(21) Appl. No.: 12/795,310

(22) Filed: Jun. 7, 2010

(65) Prior Publication Data

US 2010/0243642 A1 Sep. 30, 2010

Related U.S. Application Data

(62) Division of application No. 10/580,680, filed as application No. PCT/FR2004/002905 on Nov. 12, 2004, now Pat. No. 7,759,616.

(30) Foreign Application Priority Data

Nov. 27, 2003 (FR) ..... 03 13925

(51) Int. Cl.
*H05B 3/68* (2006.01)
*H05B 1/02* (2006.01)

(52) U.S. Cl.
USPC ..... 219/445.1; 219/447.1; 219/518

(58) Field of Classification Search
USPC ..... 219/443.1–468.2, 620–627, 518
See application file for complete search history.

(56) References Cited

U.S. PATENT DOCUMENTS

| | | | | |
|---|---|---|---|---|
| 4,931,609 | A * | 6/1990 | Aoki | 219/716 |
| 5,488,214 | A * | 1/1996 | Fettig et al. | 219/127 |
| 5,808,280 | A | 9/1998 | Gaspard | |
| 6,184,501 | B1 * | 2/2001 | Zapf | 219/447.1 |
| 6,263,782 | B1 | 7/2001 | Brindani et al. | |
| 6,350,971 | B1 * | 2/2002 | Smolenski et al. | 219/518 |
| 6,614,006 | B2 | 9/2003 | Pastore et al. | |
| 6,693,262 | B2 * | 2/2004 | Gerola et al. | 219/462.1 |
| 2001/0025848 | A1 | 10/2001 | Cornec et al. | |

FOREIGN PATENT DOCUMENTS

| | | |
|---|---|---|
| DE | 199 07 596 A1 | 8/2000 |
| EP | 0 971 562 | 1/2000 |
| EP | 1 111 490 | 6/2001 |
| EP | 1 206 164 | 5/2002 |
| FR | 2 728 132 | 6/1996 |
| WO | WO 97/19298 | 5/1997 |
| WO | WO 97/37515 | 10/1997 |

OTHER PUBLICATIONS

FR Search Report dated May 12, 2004 from corresponding FR Application 0313925.

* cited by examiner

*Primary Examiner* — Sang Y Paik
(74) *Attorney, Agent, or Firm* — Young & Thompson

(57) ABSTRACT

A method for heating a container (Ri) placed on a cooktop including heating elements which are associated respectively with inductors which form elements for detecting the presence of the container and are distributed along a frame which is embodied such that it is two-dimensional in a cooking area. The method includes searching (E20) a heating area (Zi) having the heating elements arrangement which are at least partially covered by the container and computing (E60) a power supplied by each heating element of the heating area (Zi) according to a total specified power (Pi) associated thereto and the degree of coverage of each detection element associated to heating element by the container (Ri). Utilization, in particular, is for an inductive cooktop.

14 Claims, 7 Drawing Sheets

METHOD FOR HEATING A CONTAINER PLACED ON A COOKTOP BY HEATING MEANS ASSOCIATED TO INDUCTORS

CROSS REFERENCE TO RELATED APPLICATIONS

This application is a divisional of co-pending application Ser. No. 10/580,680 filed on Oct. 12, 2006, which is the 35 U.S.C. §371 national stage of International PCT/FR04/02905 filed on Nov. 12, 2004, which claims priority to French Application No. 0313925 filed on Nov. 27, 2003. The entire contents of each of the above-identified applications are hereby incorporated by reference.

BACKGROUND OF THE INVENTION

1. Field of the Invention

The present invention relates to a method of heating a container placed on a cooktop It also relates to a cooktop adapted to implement the heating method of the invention.

It relates generally to cooktops of the kind such that a container may be placed and heated anywhere on the cooking surface.

It finds a particular, non-exclusive application in the field of induction cooktops.

2. Description of the Related Art

The document WO 97 37 515 discloses a cooktop in which a cooking area has no specific location on the cooking surface.

In the document WO 97 37 515, a plurality of standard small inductors form a two-dimensional array on the cooking surface.

A cooking container detection loop detects inductors covered by a container. That information can be transmitted to a computer connected to a control unit for programming the quantity of heat to be supplied to each of the inductors.

Thus only the inductors covered by a cooking container are energized.

However, the above document remains silent on the problem of inductors partly covered by a container.

SUMMARY OF THE INVENTION

An object of the present invention is to optimize the heating of a container placed on a cooktop with no predetermined location of the cooking centre.

To this end, a first aspect of the present invention provides a method of heating a container placed on a cooktop comprising heating means respectively associated with inductors forming means for detecting the presence of a container, the heating means associated with the inductors forming a two-dimensional array on the cooking surface.

The heating method comprises the following steps:

- a step of searching for a heating area consisting of a set of heating means at least partly covered by a container; and
- a step of calculating a power delivered by each heating means in the heating area as a function of an overall set point power associated with the heating area and a rate of coverage by the container of each detection means associated with those heating means.

The rate of coverage of the detection means associated with the heating means makes it possible to adjust the power of the resulting heating centre as a function of the size of the container and to obtain a constant power density regardless of the diameter of the container and its position on the cooking surface.

According to a preferred feature of the invention, the method further comprises a preliminary step of declaring the addition of the container to the cooking surface.

This preliminary step makes it possible to perform the search and power calculation steps only when placing a new container on the cooking surface, thus avoiding continuous operation of the inductors forming the detection means.

According to another preferred feature of the invention, the heating method comprises a step of detecting movement of a container associated with an initial heating area and a step of searching for a shifted heating area consisting of heating means respectively associated with detection means at least partly covered by the container.

Thus the heating method of the invention takes account of movement of the container on the cooking surface during cooking.

To ensure continuous heating of the container, the heating method further comprises a step of associating the overall set point power associated with the initial heating area with the shifted heating area.

According to another preferred feature of the invention, the search step comprises a step of memorizing for each heating means of the heating area a rate of coverage by a container of said detection means associated with those heating means.

In one particularly practical embodiment of the invention, the heating means are inductors forming means for detecting the presence of a container.

A second aspect of the present invention relates to a cooktop comprising heating means respectively associated with inductors forming means for detecting the presence of a container, the heating means associated with the inductors forming a two-dimensional array on the cooking surface.

The cooktop comprises means adapted to execute the heating method defined above.

The cooktop has features and advantages analogous to those described above in relation to the method of heating a container.

Other features and advantages of the invention will become further apparent in the course of the following description.

BRIEF DESCRIPTION OF THE DRAWING FIGURES

In the appended drawings, which are provided by way of nonlimiting example:

DETAILED DESCRIPTION

Figure 1:
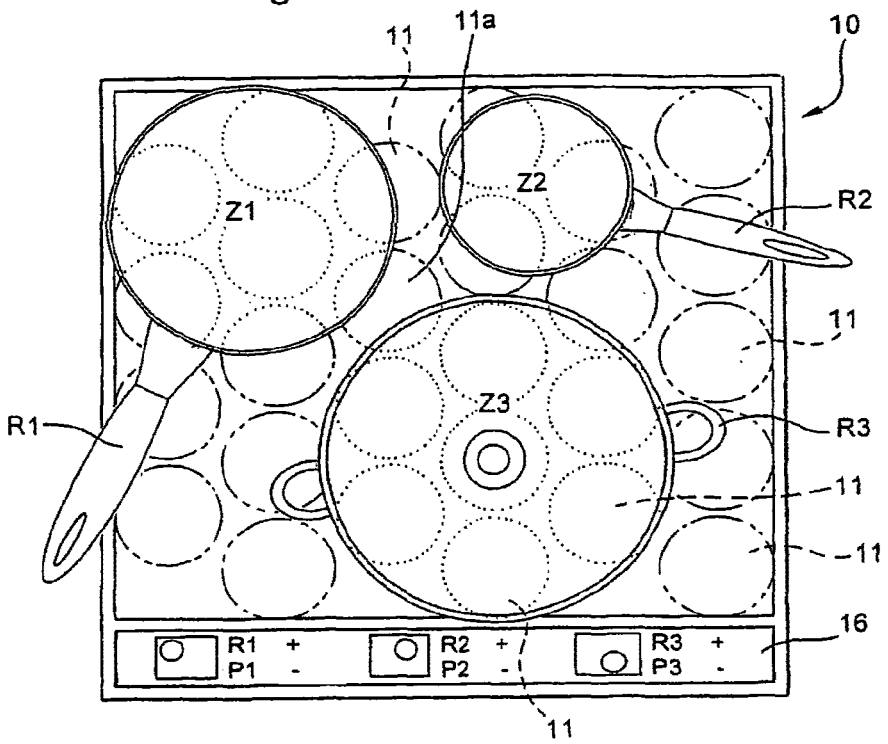
FIG. 1 is a diagram of the top of a cooktop of the invention.

A cooktop conforming to one embodiment of the invention is described first with reference to FIG. 1.

Generally speaking, the cooktop comprises heating means 11 distributed in a two-dimensional array on the cooking surface of the cooktop 10.

The cooktop therefore has a large cooking area, which can be as large as the overall size of the cooking surface, enabling one or more containers to be heated without being precisely located on the cooktop.

It is necessary to be able to detect automatically containers placed on the cooking surface of this type of cooktop, in order to activate only the heating means under those containers.

It is known in the art to use for this purpose inductors forming detection means. For example, the measured rms current flowing in each inductor could depend on the area of that inductor covered by a container.

In the embodiments of an induction cooktop described hereinafter the heating means consist of inductors arranged on the cooking surface.

The inductors 11 thus constitute both heating means and means for detecting the presence of a container.

The present invention could of course apply equally well to other types of heating means, for example radiant elements also disposed in a two-dimensional array on the cooking surface, each radiant heating centre being associated with an inductor forming detection means.

In the FIG. 1 embodiment, the cooking area under the cooking surface consists of a plurality of individual small coils or inductors arranged to cover the whole of the cooking surface.

This cooking area therefore consists of a matrix of small inductors.

In this nonlimiting embodiment, the inductors are circular and are disposed on the cooking surface in a quincunx arrangement.

The resulting cooking surface can be of any shape, for example square as in the FIG. 1 example.

The individual inductors 11 are sufficiently small for any size of container to cover at least one individual inductor.

The diameter of each individual inductor may be equal to 70 or 80 mm, for example.

To constitute a matrix of adjoining inductors that can operate individually, it is necessary for the inductors to be energized independently.

The maximum power produced by each inductor is of the order of 700 W, for example. It is therefore possible to obtain a total power of about 2800 W for an average size container covering four inductors 11.

Figure 2:
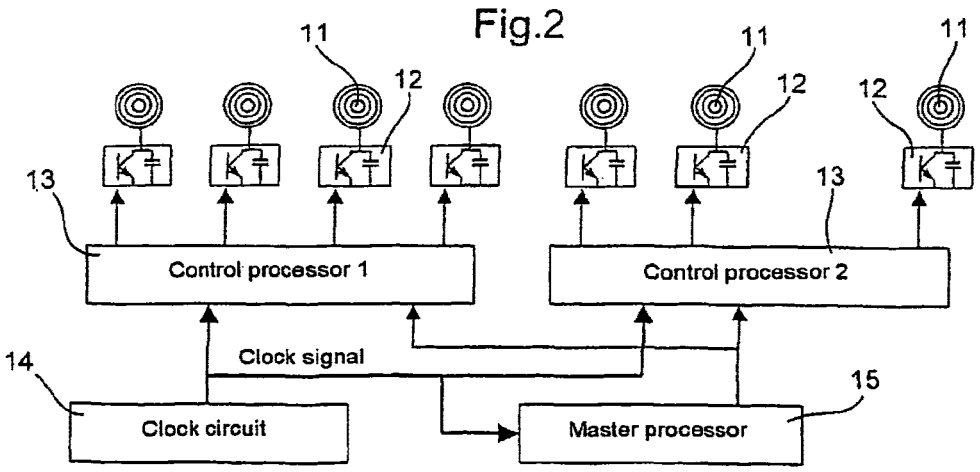
FIG. 2 shows a control circuit of heating means of the FIG. 2 cooktop.

FIG. 2 shows the power supply and control connections to each inductor 11.

Each individual inductor 11 is energized by a dedicated electronic power inverter circuit 12.

To prevent whistling or other noise resulting from audible frequencies of intermodulation between the different oscillating circuits 12, all the oscillating circuits 12 must be energized by currents having the same frequency and phase.

For example, each individual cell consisting of an inductor 11 and a power inverter 12 is tuned to a fixed frequency, for example 25 kHz.

One or more control processors 13 manage(s) all of the cells and control(s) the operation of the inductors covered by a container.

The oscillation frequencies of the oscillators 12 are synchronized by a single clock circuit 14 distributed to each processor 13 and by starting the power inverters 12 synchronously.

The control processors 13 are controlled by a master processor 15.

Power variation is obtained by pulse width modulation (PWM) of the oscillatory signal at the fixed working frequency, in the conventional way.

The control system is thereby able to handle one or more containers placed on the cooking surface and to apply a different power to each container according to a set point power set by the user.

To this end, the cooktop 10 includes a control panel 16.

Accordingly, after a phase of detecting each container R1, R2, R3, as described hereinafter with reference to FIG. 3 et the subsequent figures, the associated cooking area Z1, Z2, Z3 is displayed on the panel 16. The user can assign a set point power P1, P2, P3 to each container R1, R2, R3 detected in this way. The control system shown in FIG. 2 then distributes power homogeneously to the inductors concerned, as described hereinafter with reference to FIG. 6.

The method of induction heating a container Ri such as one of the containers R1, R2, R3 described above is described next with reference to FIG. 3.

In principle, in a declaration step E10, after placing the container Ri on the cooktop, the user requests the addition of a cooking area by pressing a key provided for this purpose on the control panel.

Although this is the logical way of using the cooktop, it is also possible for the user to request the addition of a cooking area first and then to place the container Ri on the cooktop.

The preliminary step E10 of declaring the placing of a container on the cooking surface avoids the cooktop having the container detection function activated at all times, which could cause interference.

The next step is a step E20 of searching for a new heating area Zi.

If no container is placed on the cooking surface, the new area Zi is cancelled after a particular time period, for example 1 minute.

Figure 4:
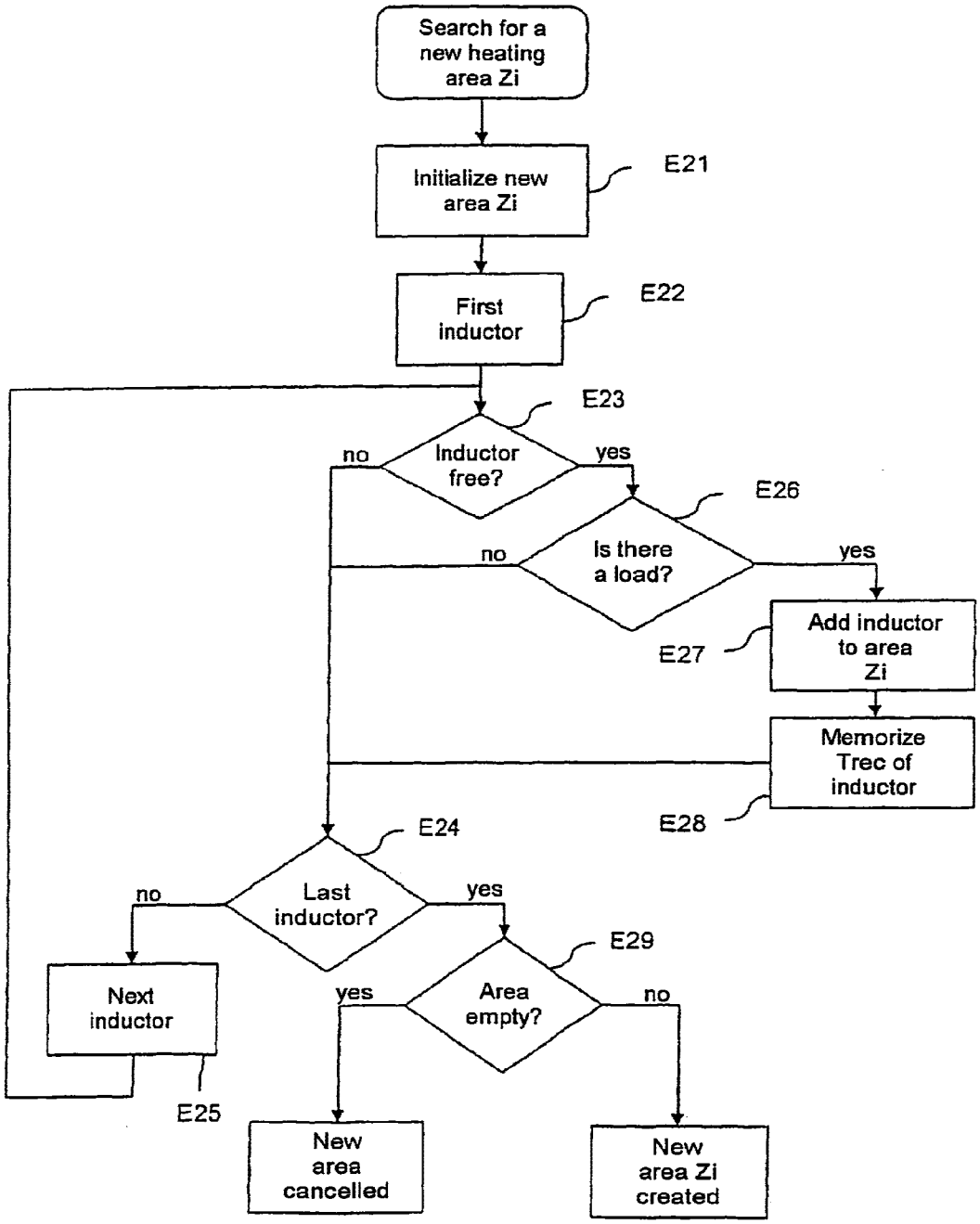
FIG. 4 is a more detailed flowchart of a step shown in FIG. 3 of searching for a new heating area, conforming to a first embodiment of the invention.

The step E20 of searching for a new heating area Zi is described next with reference to FIG. 4.

A simple way of searching for a heating area would be to test all the inductors 11 at the same time. However, that would have numerous drawbacks, such as the risk of generating a high level of noise in the container and the risk of a large and destructive peak current, in particular if the container placed on the cooktop is not suitable, for example if the container is made of aluminum. Moreover, if the container were large the power consumption could be high and might exceed the maximum authorized power of the cooktop.

The principle of detecting a new heating area Zi described hereinafter consists in testing all the inductors 11 one by one.

The search begins with a step E21 of initializing a new area Zi by initializing a memory space adapted to store temporarily the inductors constituting the heating area Zi.

A first inductor selected in a predetermined order of dealing with the inductors is considered in a step E22.

A test step E23 determines if the inductor is free or not.

The test step E23 determines if the inductor already belongs to another heating area on the cooking surface and is therefore already being used to heat another container.

This could be the situation of the inductor 11*a* in FIG. 1, for example, which cannot belong to the heating area Z3 if it belongs to the heating area Z1.

If this inductor is not free, a test step E24 verifies if it is the last inductor on the cooking surface.

If not, the next inductor is considered in a step E25 and detection continues on that new inductor.

If the inductor concerned is free after the test step E23, a test step E26 determines if there is a load above that inductor, i.e. if there is a container at least partly covering it.

In practice, the rms current in the inductor is measured. Its value depends on the area of the inductor covered by the container.

To allow relative comparison of the rms currents and thereby determine the rate of coverage of the inductors relative to each other, it is necessary, during this step of searching for a heating area, to energize each inductor in the same way, i.e. with the same duty cycle in the case of generators energized at a fixed frequency.

It will be noted that this detection by means of inductors may be used only for containers of ferromagnetic materials such as cast iron, enameled mild steel or stainless steel.

If no load is detected above the inductor, the step E24 and the subsequent steps are repeated for the next inductor on the cooking surface.

On the other hand, if the detection step E26 detects the presence of a container above the inductor, an addition step E27 adds the inductor to the heating area Zi.

A memorization step E28 is also executed for each inductor added to the heating area Zi, in order to memorize the rate of coverage TREC of the added inductor.

In practice, the test step E26 detects a container above the inductor if the rate of coverage of that inductor is greater than a predetermined threshold value, for example 40%.

This detection threshold avoids energizing inductors that are not covered by much of a container.

In practice, the rate of coverage may be determined by measuring the average current and the peak current in the inductor, as described in the document FR 2 783 370 in particular.

The ratio between these two measurements for a given PWM duty cycle gives a good approximation of the rate of coverage. It is therefore possible to fix a lower limit for this rate of coverage below which the inductor is considered not to be sufficiently covered to work properly.

The relative rates of coverage for inductors in the same area (covered by the same container) may then be compared.

A test step E24 then verifies whether the inductor concerned is the last inductor; if not, all the steps described above are repeated for the next inductor.

A test step E29 verifies if the resulting area Zi is empty.

This is the case in particular if no container has been placed on the cooking surface.

In this case, the new area Zi is cancelled.

If not, the new heating area Zi is memorized.

The identification of this new heating area Zi is materialized by a display step E30 in which the presence and the position of the container Ri are displayed on the control panel 16 of the cooktop.

The method of searching for a container described above with reference to FIG. 4 takes a relatively long time, however, especially if the number of free inductors is large. This is the case when placing a first container on the cooking surface.

An improved method of searching for a heating area Zi is described hereinafter with reference to FIG. 5. In principle, this method takes account of the fact that, to belong to a heating area, the inductors of that heating area must be adjacent.

As above, this search method begins with a step E31 of initializing a new area Zi. A first inductor is then considered in a step E32.

A test step E33 verifies whether that inductor is free, i.e. whether it already belongs to another listed heating area.

If the inductor is not free, a test step E34 verifies if it is the last inductor. If so, the new heating area is cancelled. If not, the next inductor is considered in a step E35.

If the inductor is free after the test step E33, a test step E36 verifies if there is any load above the inductor, i.e. the presence of a container placed on the cooking surface above the inductor is detected.

If not, the next inductor is considered in a step E37 and steps E33 onwards are repeated for that inductor.

Otherwise, if the presence of a container above the inductor is detected, a step E37 adds that inductor to the heating area Zi. The rate of coverage TREC of the inductor is memorized in parallel with this in a memorization step E38.

These steps are substantially identical to those described above with reference to FIG. 4.

Then, to improve the search for inductors belonging to the new heating area Zi, a step E39 draws up a list of inductors not belonging to another existing heating area adjoining the heating area Zi being constituted.

In practice, all the inductors adjoining at least one of the memorized heating means in the heating area Zi are considered if that inductor is free, i.e. if it does not already belong to another heating area.

A test step E40 then verifies if that list is empty. If not, the next adjoining inductor is considered in a step E41.

A step E42 of updating the list eliminates this inductor from the list of free inductors adjoining the area.

A test step E43 analogous to the test step E36 verifies whether there is a load above this inductor.

If so, the steps from step E37 onwards are repeated for that inductor. A new list of inductors adjoining the area is drawn up on the basis of the modified heating area.

If, following the test step E43, the inductor is not under a container, in other words if its rate of coverage by a container is less than 40%, for example, the steps E40 onwards are repeated for the list of free inductors adjoining the heating area to be constituted.

If that list is empty, it is deduced that there is no other inductor adjoining the area covered by a container, and the new heating area Zi is created.

As previously, that creation is visualized by the display in a step E30 of the presence and position of the container Ri.

The next step is a step E30 of entering an overall set point power Pi associated with the container Ri. This step is executed by the user, who can select a required power level on the control panel, for example a level from 1 to 15 corresponding to a power scale from 100 to 2800 W.

From the overall set point power Pi associated with the heating area Zi it is possible to calculate the power delivered by each inductor in the heating area Zi.

The power delivered by each inductor preferably depends on the rate of coverage of the inductor.

Figure 6:
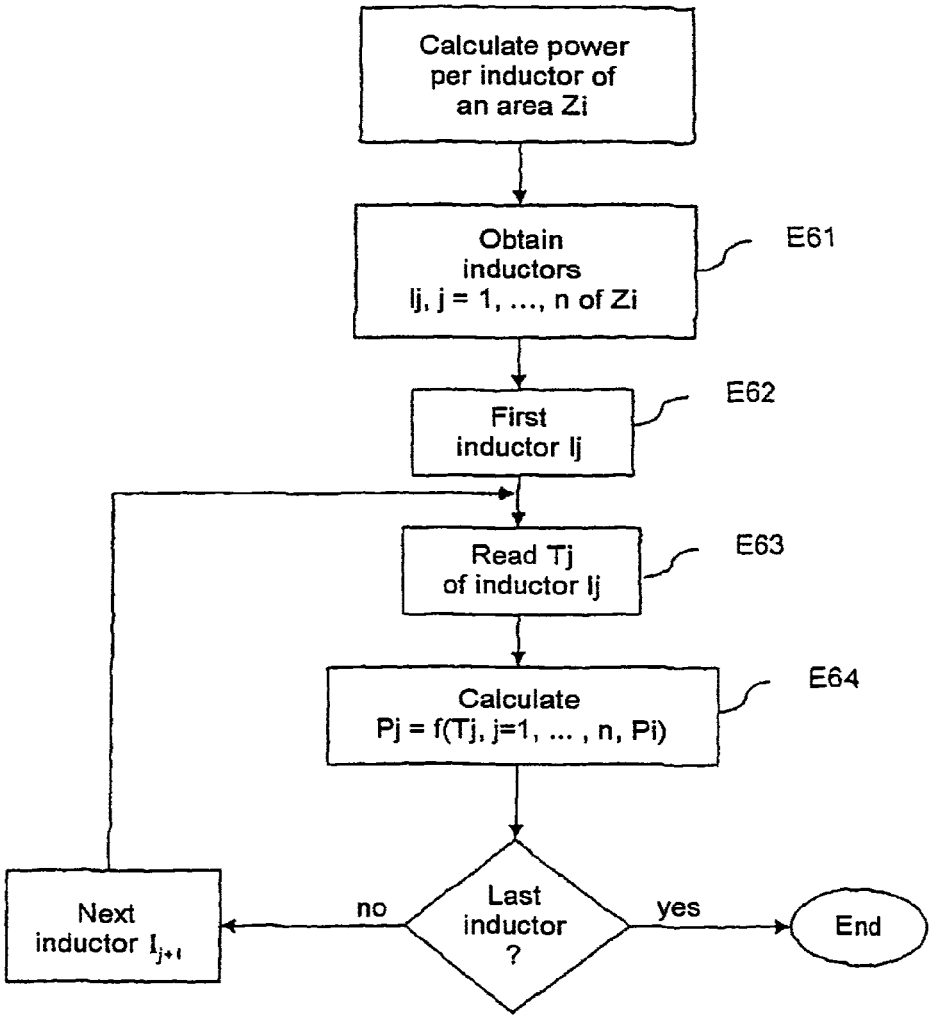
FIG. 6 is a flowchart of a step shown in FIG. 3 of calculating the power per inductor.

As shown in FIG. 6, to calculate the power for each of the inductors Ij (j=1 to n, where n is the number of inductors in the heating area Zi) of a heating area Zi, a step E61 is executed to obtain the inductors Ij.

A first inductor Ij in the heating area Zi is then considered in a step E62.

The rate of coverage is typically from 40 to 100%. A reading step E63 obtains the value of the rate of coverage associated with the inductor Ij memorized on detecting the container when constituting the heating area Zi.

A calculation step E64 then determines the unit power Pj associated with that inductor Ij.

In practice, the unit power Pj delivered by the inductor Ij is a function of the overall set point power Pi and the rate of coverage of each inductor in the heating area Zi.

Power may be distributed to the inductors in accordance with different laws, as a function of the required effect.

In a first embodiment, the priority is a homogeneous power density to distribute power homogeneously over the bottom of the container.

This distribution minimizes the field radiated by the partly covered inductors as the current flowing in those inductors is reduced.

In this case, the function for calculating the power Pj delivered by the inductor Ij is of the following type:

$$Pj = (Pi \times Tj) \Big/ \sum_{j=1}^{n} Tj$$

Figure 7:
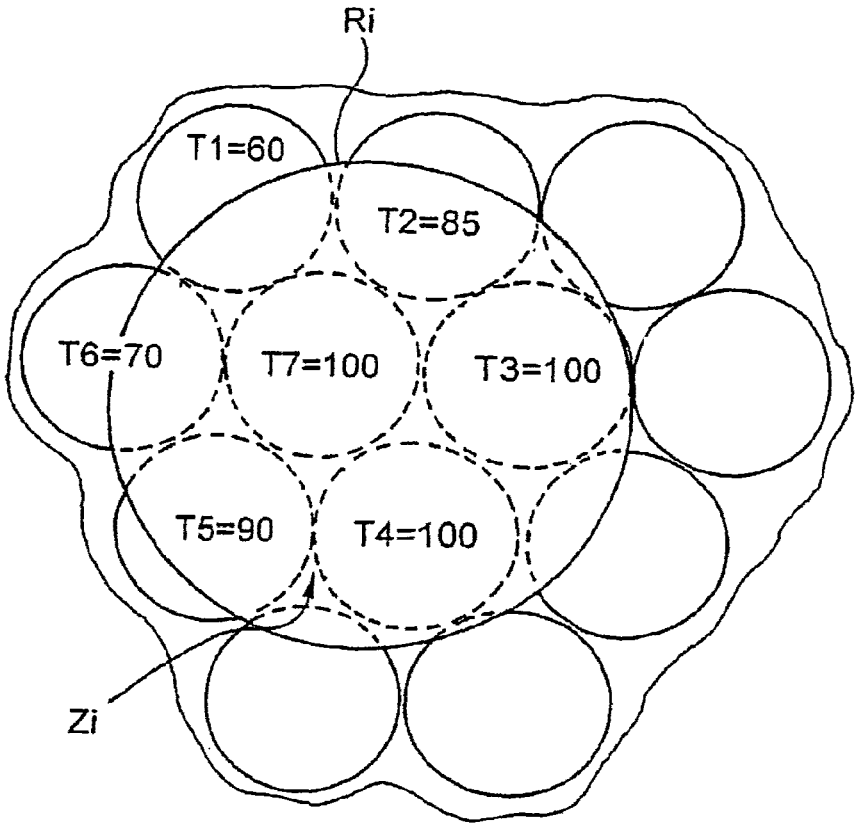
FIG. 7 shows one example of a heating area covered by a container.

Accordingly, as shown in the FIG. 7 example, for a heating area Zi comprising seven partly covered inductors with rates of coverage Tj from 60 to 100%, the above formula gives the following values for each inductor for a set point power Pi equal to 2800 W:

P1=278 W
P2=393 W
P3=463 W
P4=463 W
P5=416 W
P6=324 W
P7=463 W

A constant power density can therefore be obtained regardless of the diameter of the container.

In a second embodiment, the power to partly covered inductors is increased if they are under the edges of a container.

The edges of containers, especially high casseroles, dissipate large amounts of energy.

The formula for calculating the power Pj associated with each inductor Ij may be as follows:

$$Pj = (Pi / Tj) \Big/ \sum_{j=1}^{n} 1 / Tj$$

That formula gives the following power distribution for each inductor Pj, with a set point power Pi equal to 2800 W:

P1=557 W
P2=393 W
P3=334 W
P4=334 W
P5=371 W
P6=477 W
P7=334 W

This power distribution formula assigns priority to heating the edges of a container and is particularly beneficial when a container is centered on one of the inductors so that a ring of inductors disposed under the edge of the container all have exactly the same rate of partial coverage.

Of course, many other formulas can be used to calculate the power delivered by each inductor by weighting the value of the rate of coverage of each inductor.

There have been described above the detection of a heating area Zi and the calculation of the power associated with each inductor of that heating area Zi from a set point power value set by the user.

However, it is frequently the case that a container on this kind of cooktop is moved during heating, to agitate its contents or to add an ingredient.

Moving a container must not degrade its heating.

The control system for the various inductors must also be adapted to track the movement of a container on the cooking surface so as to activate and deactivate the inductors respectively covered and uncovered as the container moves.

Figure 3:
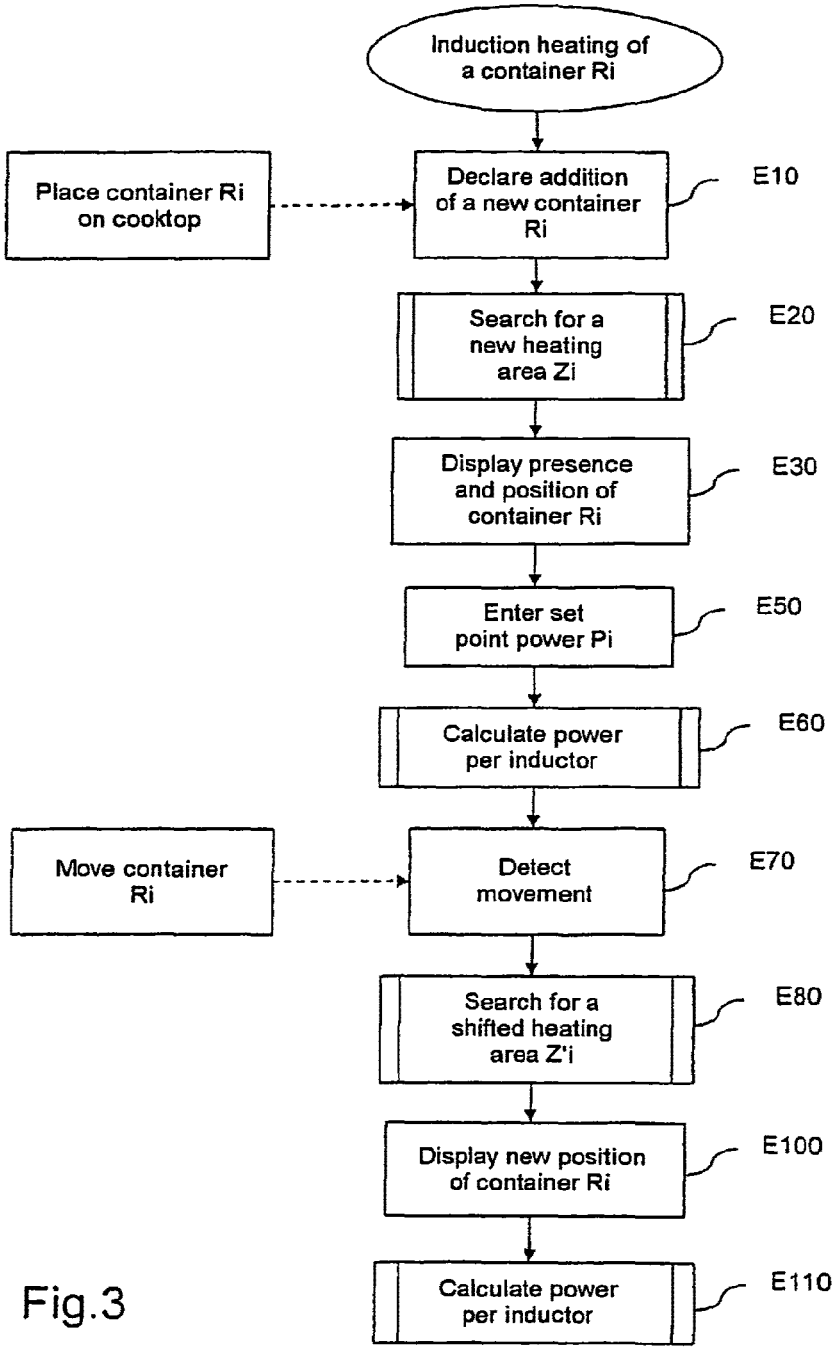
FIG. 3 is a flowchart of a heating method of the invention.

As shown in FIG. 3, a step E70 of detecting movement of the container is executed during movement of the container Ri by the user.

This movement of the container is detected automatically by the control system.

It may be detected in various ways:

one of the inductors in the heating area Zi is uncovered, in particular in the event of absence of the container when the latter is removed from the cooking surface;

the control parameters of at least one of the inductors of the heating area Zi are greatly modified to maintain the set point power in that inductor; in the case of fixed-frequency pulse width modulation control, a large variation in the duty cycle is then observed in the control system;

the parameters measured at the level of an inductor vary greatly, although the control parameters remain unchanged; this variation can be observed by measuring the current in the inductor or in one of the control transistors of that inductor.

If the cooktop management system detects movement of a container, a step E80 searches for a shifted heating area Z'i.

Figure 8:
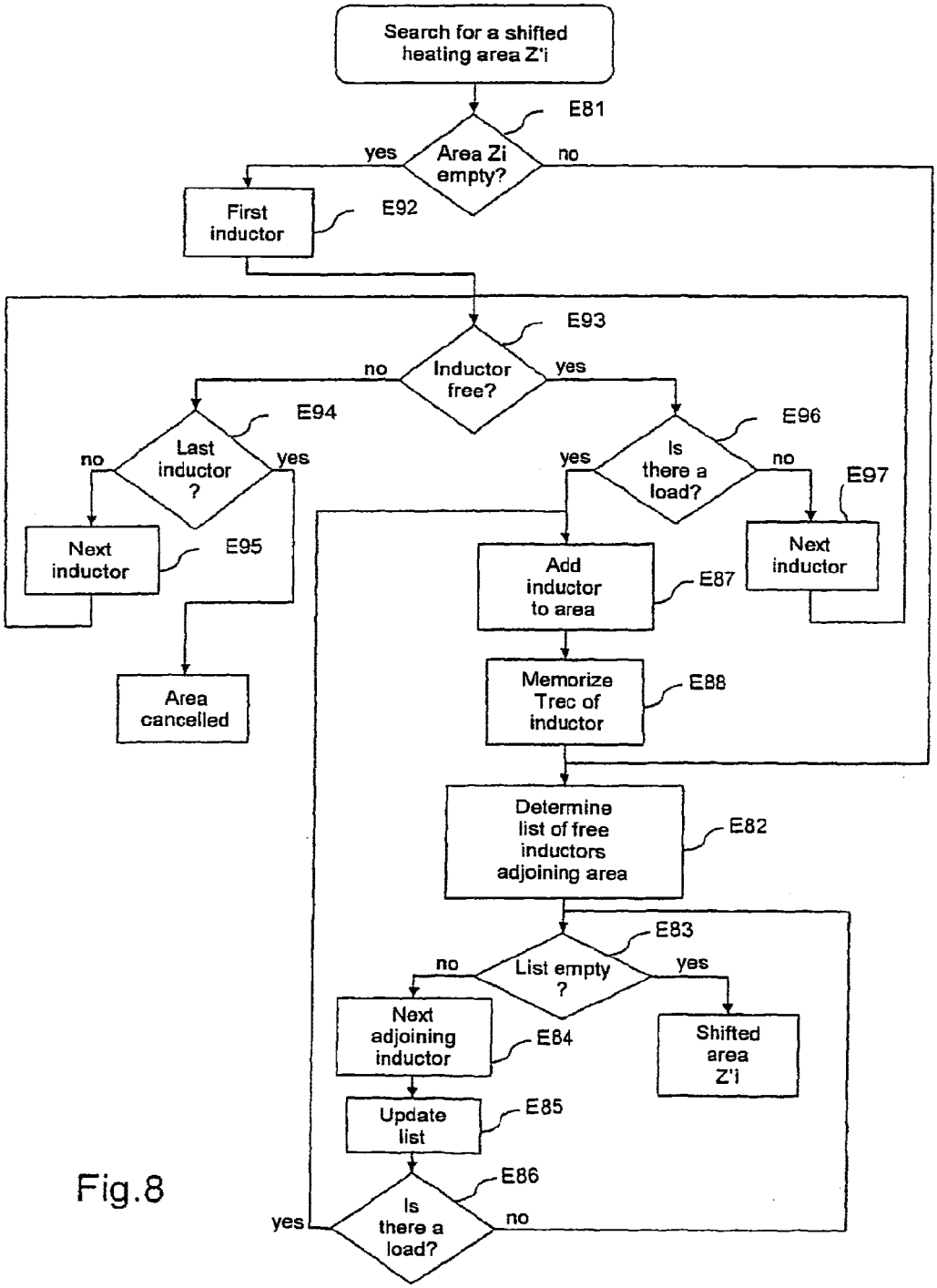
FIG. 8 is a flowchart of a step shown in FIG. 3 of searching for a shifted heating area.

This search step 80 is shown in FIG. 8 and is substantially identical to the search step E20 described above with reference to FIG. 5.

This search step begins with a test step E81 to verify if the initial heating area Zi is empty.

If the initial heating area Zi is not completely empty, i.e. if the container has only been moved a relatively short distance on the cooking surface, so that it is still covering some inductors of the initial area Zi, a step E82 determines a list of the free inductors adjoining the heating area Zi.

This determination step is identical to the determination step E39 described above with reference to FIG. 5.

A test step E83 verifies if the list is empty.

If so, the recipient has been moved only slightly and is still above all the inductors of the initial heating area Zi.

The new shifted area Z'i is then considered with the modified rate of coverage of each inductor to recalculate the power delivered by each of the inductors of the shifted area Z'i.

If the list of free inductors adjoining the heating area is not empty, a step E84 considers an inductor adjoining of that list. An updating step E85 eliminates that adjoining inductor from the list constructed in step E82.

In a test step E86, the control system verifies the presence or absence of a load above this inductor.

This step of detecting the presence of a container is identical to the test step E36 described above with reference to FIG. 5.

In the absence of a container, the steps E83 onwards are repeated for an adjoining inductor until the list of free adjoining inductors is empty.

When the presence of a container above one of the inductors is detected, the latter is added to the shifted heating area Z'i in an addition step E87.

A parallel memorization step E88 memorizes the rate of coverage TREC of the added inductor.

A step E82 then determines a new list of free inductors adjoining the modified heating area and the steps E83 onwards are repeated.

Figure 5:
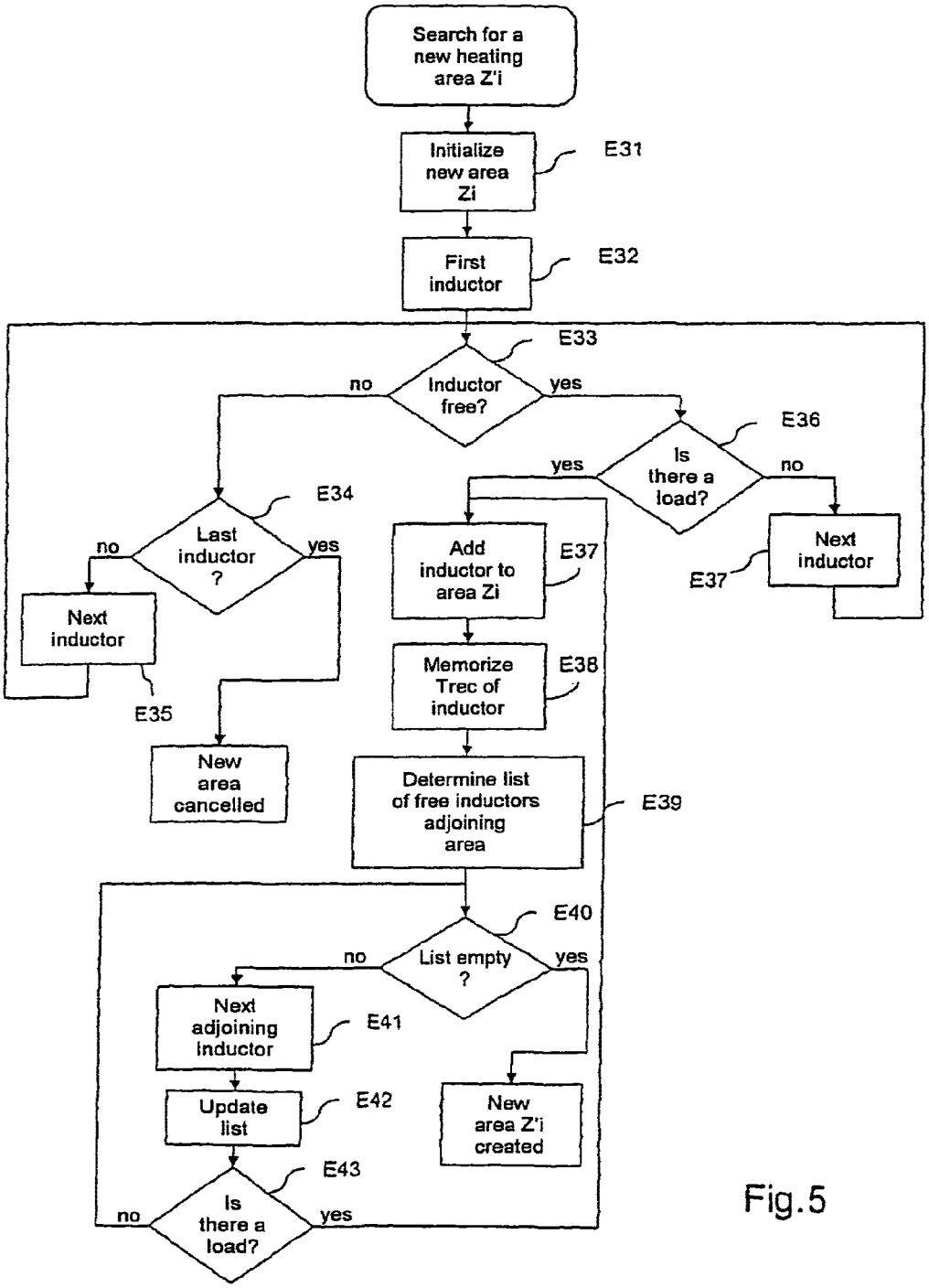
FIG. 5 is a more detailed flowchart of a step shown in FIG. 3 of searching for a new heating area, conforming to a second embodiment of the invention.

If, after the test step E81, the initial heating area Zi is empty, the shifted heating area Z'i is detected in the same way as if it were a new heating area, as shown in FIG. 5.

Thus the steps E92 to E97 are identical to the steps E32 to E37, respectively, described above with reference to FIG. 5 and do not need to be described again.

Thus a shifted heating area Z'i is determined on completion of the search step E80.

The determination of a shifted heating area Z'i is materialized in concrete terms by the display during a display step E100 of a new position of the container Ri on the control panel 16 of the cooktop 10.

Because the step E80 of searching for a shifted area Z'i follows a step E70 of detecting movement of the container and not a step E10 of declaring the addition of a new container, the control system is adapted to associate with the shifted heating area Z'i the overall set point power Pi associated with the initial heating area Zi.

This association of the set point power Pi is effected during a step E110 of calculating the power delivered by each inductor of the shifted heating area Z'i.

This power calculation step E110 is executed in the same way as for an initial heating area Zi, on the basis of the overall set point power Pi and the rate of coverage associated with each inductor of the shifted heating area Z'i.

In the above example of shifted heating area detection, the second way of searching for a container described with reference to FIG. 5 has been described again because it has advantages in terms of speed, especially if the container is not completely removed from the cooking surface. In fact it suffices to test only the inductors adjoining inductors of the initial heating area that remain covered.

The method described with reference to FIG. 4 of detecting the inductors one by one could also be used, of course.

The induction cooktop described above, and the associated heating methods, give the user great flexibility of use.

In fact, there are no constraints as to the dimensions and location of the container on the cooktop.

In particular, although the containers are circular in the examples illustrated in FIG. 1, any type of container shape, square or oval, and varied sizes could be used.

At the limit, a container of substantially the same size as the cooking surface could be used, the maximum authorized power for the cooktop then being distributed over all of the inductors disposed in a matrix on the cooking surface.

Furthermore, thanks to the method of detecting and finding the container described above, the container may be moved on the cooking surface without changing its heating power.

In particular, if the container is removed from the cooking surface and then replaced on it, the control system is adapted to detect the presence of the container and to calculate a shifted heating area as described with reference to FIG. 8 when there has been no step E10 of declaration of the addition of a new container by the user.

Of course, numerous modifications may be made to the embodiments described above without departing from the scope of the invention.

In particular, there has been described above a cooktop having heating means consisting of inductors.

The heating method could equally be implemented using heating means consisting of radiant elements, provided that inductive detection means are associated with each heating means. In this case, it is necessary to use a ferromagnetic material container to enable detection of the container by induction.

What is claimed is:

1. A method for searching for a heating area (Zi) comprising a set of inductors at least partly covered by a container (Ri) placed on a cooktop, the cooktop comprising inductors forming means (11) for detecting a presence of a container distributed in a two-dimensional frame in a cooking plane, comprising:

a step (E37, E87) of adding an inductor in said heating area (Zi) searched for when the presence of the container (Ri) is detected opposite said inductor;

a step (E39, E82) of drawing up a list of free adjacent inductors, said free adjacent inductors not belonging to another heating area and being adjacent said heating area (Zi) searched for;

a step (E43, E86) of testing detection of the presence of a container (Ri) opposite a free adjacent inductor from said list of inductors, said testing step (E43, E86) being repeated only for each free adjacent inductor from said list of inductors; and a step (E37, E87) of adding each free adjacent inductor in said heating area (Zi) searched for if the presence of the container (Ri) is detected opposite said free adjacent inductor.

2. The searching method according to claim 1, wherein the step (E39, E82) of drawing up a list of free adjacent inductors is adapted to drawing up a list of the inductors adjacent to at least one of the inductors added to said heating area (Zi) searched for.

3. The searching method according to claim 1, wherein said step (E39, E82) of drawing up a list is repeated when a free adjacent inductor is added in said heating area (Zi) searched for.

4. The searching method according to claim 1, wherein, in said test step (E43, E86), said free adjacent inductor is removed from said list of free adjacent inductors.

5. The searching method according to claim 4, wherein said heating area (Zi) searched for is created when said list of free adjacent inductors is empty.

6. The searching method according to claim 1, the method further comprising a preliminary step (E36, E96) of detecting the presence of a container opposite an inductor of the cooking plane which processes said inductors in a predetermined order.

7. The searching method according to claim 1, the method further comprising a preliminary step (E10) of declaring addition of said container to the cooking plane.

8. The searching method according to claim 1, the method further comprising a step (E70) of detecting movement of the container (Ri) associated with the heating area (Zi) searched for, said search method being used to search for a shifted heating area (Z'i) comprising inductors covered at least partially by said container (Ri).

9. The searching method according to claim 8, the method further comprising a step (E110) of associating with the shifted heating area (Z'i) an overall set point power (Pi) associated with an initial heating area (Zi).

10. The searching method according to claim 1, the method further comprising a step (E38, E88) of storing a rate of overlap (TREC) of said inductor by the container for each inductor added in the heating area (Zi) searched for.

11. The searching method according to claim 1, wherein, in the test step (E43, E86), the presence of a container opposite an inductor is detected when a rate of overlap of said inductor is greater than a predetermined threshold value.

12. The searching method according to claim 11, wherein said predetermined threshold value is equal to 40%.

13. A cooktop comprising inductors forming means (11) for detecting by induction the presence of a container, said inductors being distributed in a two-dimensional frame in the cooking plane, and a cooktop management system configured to execute the method of searching of claim 1.

14. A method for searching for a heating area (Zi) comprising a set of inductors at least partly covered by a container (Ri) placed on a cooktop, the cooktop comprising inductors forming means (11) for detecting a presence of a container distributed in a two-dimensional frame in a cooking plane, comprising:

a step (E37, E87) of adding an inductor in said heating area (Zi) searched for when the presence of the container (Ri) is detected opposite said inductor;

a step (E39, E82) of determining adjacent inductors adjoining said heating area searched for;

a step (E39, E82) of drawing up a list of free adjacent inductors among said adjacent inductors, said list of inductors comprising adjacent inductors no belonging to another heating area;

a step (E43, E86) of testing detection of the presence of a container (Ri) opposite a free adjacent inductor from said list of inductors, said testing step (E43, E86) being repeated only for each free adjacent inductor from said list of inductors and each free adjacent inductor being removed from said list of inductors after testing; and a step (E37, E87) of adding each free adjacent inductor in said heating area (Zi) searched for if the presence of the container (Ri) is detected opposite said free adjacent inductor, said heating area searched for being created as soon as said list of inductors is empty.

* * * * *